United States Patent [19]

Giometti

[11] Patent Number: 4,715,239

[45] Date of Patent: Dec. 29, 1987

[54] ENGINE STARTER GEARING

[75] Inventor: Paul F. Giometti, Horseheads, N.Y.

[73] Assignee: Facet Enterprises, Inc., Tulsa, Okla.

[21] Appl. No.: 907,485

[22] Filed: Sep. 15, 1986

Related U.S. Application Data

[63] Continuation-in-part of Ser. No. 575,199, Jan. 30, 1984, Pat. No. 4,611,499.

[51] Int. Cl.[4] ..... F02N 11/00

[52] U.S. Cl. ..... 74/6; 74/7 A; 192/103 A; 192/114 R

[58] Field of Search ..... 74/6, 7 R, 7 A, 7 C; 192/103 A, 105 B, 114 R

[56] References Cited

U.S. PATENT DOCUMENTS

| | | | |
|---|---|---|---|
| 3,171,524 | 3/1965 | Croft et al. | 192/105 B |
| 3,263,509 | 8/1966 | Digby | 74/6 |
| 3,915,020 | 10/1975 | Johnson | 74/6 |
| 4,322,985 | 4/1982 | Mortensen | 192/114 R X |
| 4,346,615 | 8/1982 | Yoneda et al. | 74/7 A |
| 4,425,812 | 1/1984 | Williams | 74/6 |
| 4,611,499 | 9/1986 | Giometti | 74/7 A |

*Primary Examiner*—Allan D. Herrmann
*Attorney, Agent, or Firm*—Remy J. VanOphem

[57] ABSTRACT

Centrifugally disengageable engine starter gearing selectively starting an engine having a starting gear. The engine starter gearing includes a power shaft, a sleeve slidably secured to the power shaft, a pinion gear slidably mounted to the power shaft and movable into engagement with the starting gear, a driven clutch member secured to the pinion gear and having a circular recess with an inclined or conical surface therein, a driving clutch member mounted to the sleeve, mutually engageable clutch teeth on the driving and driven clutch members, a barrel housing having an open end and being at least partly fitted over the driving and driven clutch members, an abutment confining the driving and driven clutch members within the housing, a resilient member biasing the driving and driven clutch members into mutual engagement, a radially inwardly extending shoulder on the driving clutch member adjacent the circular recess. A plurality of centrifugal flyweight members are annularly arranged in the circular recess. Each centrifugal flyweight member has an inclined surface abutting the conical surface of the driven clutch member and operative to displace the driving clutch member in the first axial direction in response to centrifugal force. A plurality of cavities are formed in the driven clutch member. The plurality of cavities extend from the circular recess and cooperate with at least a portion of the centrifugal flyweight members to prevent circumferetial movement of the plurality of centrifugal flyweight members while permitting radial movement thereof.

9 Claims, 3 Drawing Figures

ENGINE STARTER GEARING

CROSS-REFERENCE TO RELATED APPLICATION

This application is a continuation-in-part of my co-pending application Ser. No. 575,199, filed on Jan. 30, 1984, now U.S. Pat. No. 4,611,499.

BACKGROUND OF THE INVENTION

1. Field of the Invention

The present invention relates to engine starter gearing for an engine and more particularly to engine starter gearing of a positive shift type, including a dentil clutch to provide driving and overrunning features and further including provisions for effecting the automatic separation of the clutch teeth after the engine becomes self-running.

2. Description of the Prior Art

The present invention, like the invention described in the aforesaid co-pending application Ser. No. 575,199, now U.S. Pat. No. 4,611,499, is an improvement over the starter gearing system described in U.S. Pat. No. 3,263,509 entitled "Engine Starter Drive" and issued Aug. 2, 1966, to James Digby. The above referenced patent disclosed an engine starter gearing using centrifugal weights and a conical thrust washer for separating dentil clutch teeth after engine start-up to prevent long periods of clutch overrunning and accompanying deleterious wear on the clutch teeth. An annular recess was formed in the driven clutch member. In Digby, a circular recess is provided in the face of the driven clutch member facing the driving clutch member. An annular thrust washer is fitted in the recess and abuts the driving clutch member. A conical surface is provided in the annular thrust washer facing the driven clutch member. A plurality of centrifugal weight members are also provided in the circular recess. The centrifugal weight members are provided with an inclined surface cooperating with the conical surface in the annular thrust washer, such that, when an overrunning condition occurs, the centrifugal weight members move outwardly and the inclined surface engages the conical surface of the annular thrust washer so as to bias the driving clutch member away from the driven clutch member. The centrifugal weight members are prevented from axial or rotational movement by pins extending through suitable bores in the driven clutch member and the centrifugal weight member.

While the engine starter gearing of Digby has been satisfactory in operation, it is difficult and expensive to assemble. This is true because a plurality of movable pins and centrifugal flyweight members must be somehow maintained in position relative to the driven clutch member during the assembly of the driven clutch member to the driving clutch member. Furthermore, the weight and, therefore, the effectiveness, of the centrifugal flyweight members is reduced by the existence of a substantial bore therethrough, in comparison to the size of the centrifugal flyweight member, for admission of the pin. The bore through the centrifugal flyweight members further reduces the strength of the flyweight members and, accordingly, limits the materials and dimensions which may advantageously be used for the centrifugal flyweight members. Further, the assembly of the engine starter gearing of Digby was made more difficult and expensive by virtue of the fact that the annular thrust washer was a separate component.

What is needed, therefore, is an improved engine starter gearing using a centrifugal flyweight clutch separator which is easier and less expensive to assemble and which eliminates the need for an annular thrust washer by combining its function with another element of the engine starter gearing. Furthermore, what is needed is such an engine starter gearing having a more solid, compact, and durable configuration for the centrifugal flyweight member.

SUMMARY OF THE PRESENT INVENTION

The present invention provides a novel and improved engine starter gearing. The engine starter gearing of the present invention provides a centrifugal weight clutch separator using solid unitary centrifugal flyweight members which facilitate the manufacture of the flyweight members and the assembly of the flyweight members to the engine starter gearing.

In particular, the engine starter gearing of the present invention provides a power shaft, a sleeve slidably secured to the power shaft, and helical splines on one extremity of the sleeve. A pinion gear is slidably journalled to the power shaft for axial movement relative thereto, the pinion gear being adapted for movement into and out of engagement with the starting gear of the engine to be started. A driven clutch member is secured to the pinion gear for movement therewith. A circular recess is formed in the driven clutch member. A driving clutch member is slidably mounted on the helical splines of the sleeve. The driving and driven clutch members have complementary mutually engageable inclined teeth for transmitting torque therebetween in one direction of relative rotation.

A barrel housing is slidably supported on the sleeve and is provided with an open end such that the barrel housing may be fitted over the driving and driven clutch members. The driving and driven clutch members are contained within the barrel housing by abutment means. A resilient member is disposed within the barrel housing and abuts the driving clutch member so as to bias the driving and driven clutch members into mutual engagement. A radially inwardly extending shoulder is formed on the driving clutch member adjacent the circular recess formed in the driven clutch member.

A plurality of centrifugal flyweight members are annularly arranged in the circular recess. The plurality of centrifugal flyweight members each have an inclined surface abutting an inclined surface of the driven clutch member, thereby eliminating the need for a thrust ring of the aforesaid co-pending application Ser. No. 575,199, now U.S. Pat. No. 4,611,499. The plurality of centrifugal flyweight members are operative to displace the driving clutch member in a first axial direction in response to centrifugal force. A plurality of partial circular recesses or cavities are formed in the driven clutch member. The plurality of cavities each extend from the circular recess and slidably receive at least a portion of an associated one of the plurality of centrifugal flyweight members to prevent circumferential movement of the plurality of centrifugal flyweight members, while permitting radial movement thereof.

In the preferred embodiment of structure of the present invention, the cavities are formed longitudinally of the circular recess. Each of the flyweight members includes a portion extending longitudinally from the inclined surface into the recess.

A primary object of the present invention is to provide an engine starter gearing which has a reduced number of components and which, thereby, is easy to assemble. The present invention accomplishes this object by providing a plurality of unitary centrifugal flyweight members, each of which has an inclined surface which is directly engageable with an inclined surface in the starter gearing pinion so as to reduce the number of components which must be secured together during assembly.

These and many other objects, features and advantages of the present invention will become apparent to those skilled in the art when the following detailed description of the preferred embodiment is read together with the drawings appended hereto.

DETAILED DESCRIPTION OF THE PREFERRED EMBODIMENT

Figure 1:
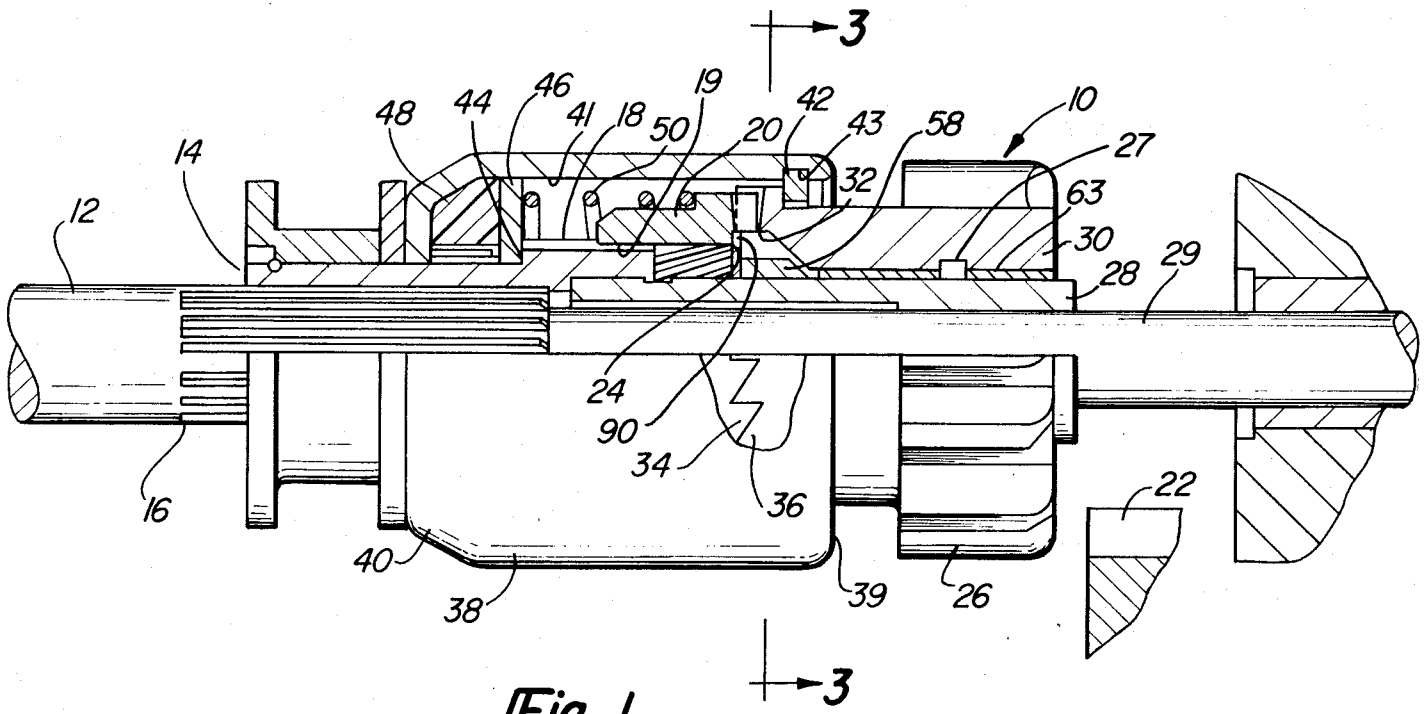
FIG. 1 is a side elevational view, partly broken away and partly in section, of the preferred embodiment of structure for an engine starter gearing according to the present invention.

Referring now to the drawing and more particularly to FIG. 1 thereof, there is illustrated a starter drive 10 for an engine, not shown, mounted to the power shaft 12 of a starting motor, also not shown. The starter drive 10 includes an axially extending sleeve 14 connected to the power shaft 12 by straight splines 16. The axially extending sleeve 14 is, therefore, axially movable relative to the power shaft 12 but may not rotate relative thereto. The external surface of the right-hand extremity of the axially extending sleeve 14, as illustrated, has external helical splines 18 formed thereon. A driving clutch member 20 has internal helical splines 19 threaded onto the external helical splines 18 of the axially extending sleeve 14. The driving clutch member 20 is, therefore, adapted for movement towards and away from a starting gear 22 of the engine to be started. The driving clutch member 20 is illustrated in its engaged position in the drawing. In the engaged position, the driving clutch member 20 projects past the right end of the axially extending sleeve 14. The rightmost edge, as illustrated, of the internal helical splines 19 of the driving clutch member 20 forms a radially inwardly extending shoulder 24, for a purpose to be described later.

A sleeve 28 is slidably supported on a reduced diameter portion 29 of the power shaft 12. One end of the sleeve 28 is secured to the axially extending sleeve 14. A pinion gear 26 is journalled on a bearing 63 and retained thereon by a retainer 27. The bearing 63, in turn, is slidably mounted on the sleeve 28 thereby permitting the pinion gear 26 to be axially and rotatably movable relative to the power shaft 12. The pinion gear 26 is adapted for movement into and out of engagement with the starting gear 22 of the engine to be started. A driven clutch member 30 is integrally formed with the pinion gear 26 and extends therefrom towards the driving clutch member 20. An annular or circular recess 32 is provided in the driven clutch member 30 adjacent the driving clutch member 20. The circular recess 32 cooperates with the sleeve 28 to define an annular channel therebetween.

The adjacent faces of the driving clutch member 20 and driven clutch member 30 are provided with dentil teeth 34 and 36, respectively, which are complementary mutually engageable inclined torque transmitting dentil teeth. The dentil teeth 34 and 36 are of the sawtooth variety to provide a one-way overrunning clutch connection.

A housing 38 having an open end 39 and a closed end 40 is slidably supported at its closed end 40 on an external surface of the axially extending sleeve 14. The housing 38 is barrel-shaped and fitted over the driving clutch member 20 and partially over the driven clutch member 30. A lock ring 42 is seated in a groove 43 adjacent the open end 39 of the housing 38. The lock ring 42 has sufficient radial length to engage the driven clutch member 30 to thereby confine the driven clutch member 30 and the driving clutch member 20 within a cavity 41 of the housing 38.

The axially extending sleeve 14 is provided with a radial shoulder 44 in an intermediate location therealong to provide an abutment for a disk or washer 46 slidably journalled on the axially extending sleeve 14. A resiliently yieldable annular member 48, preferably formed of an elastically deformable material, such as rubber, is compressively confined between the disk 46 and the closed end 40 of the housing 38. A resilient spring member 50 is compressively confined within the cavity 41 of the housing 38 between the washer 46 and the driving clutch member 20 to provide a biasing force urging the driving clutch member 20 into engagement with the driven clutch member 30.

An advancement apparatus, not illustrated in the drawing but well known in the art, is provided for moving the starter drive 10 towards and away from the starting gear 22 of the engine.

Figure 2:
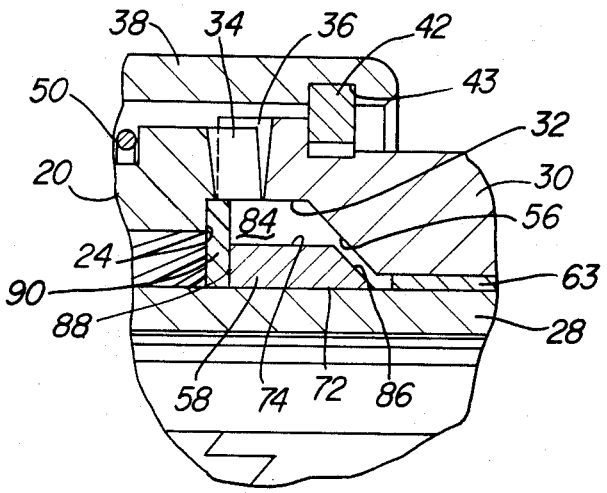
FIG. 2 is an enlarged fragmentary view of the engine starter gearing shown in FIG. 1.
Figure 3:
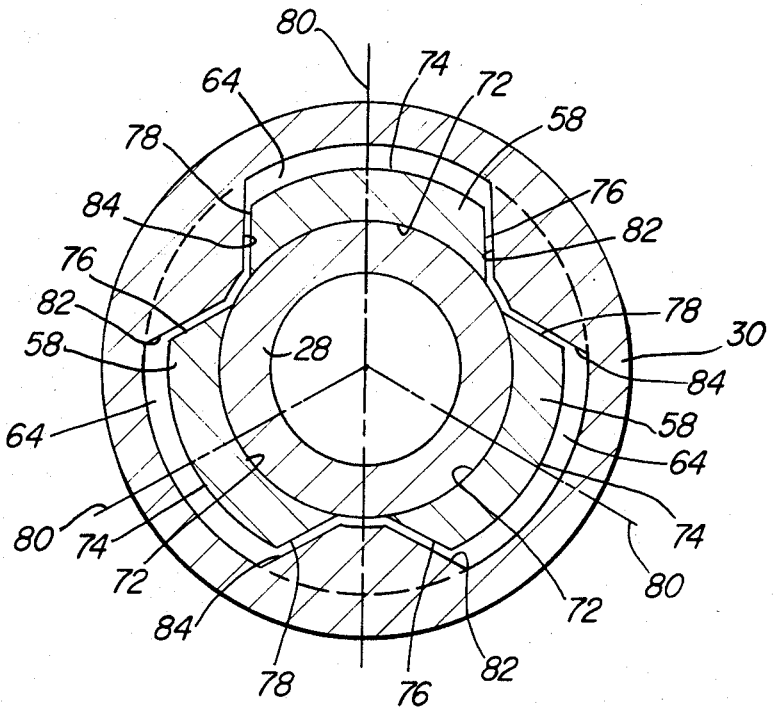
FIG. 3 is a cross-sectional view taken along lines 3—3 of FIG. 1.

As is shown most clearly in FIGS. 2 and 3, a plurality of centrifugal flyweight members 58 are fitted in partial circular recesses 64 of the circular recess 32. Each of the centrifugal flyweight members 58 is appropriately dimensioned for cooperation with the partial circular recesses 64 and a conical inner surface 56 of the driven clutch member. Thus, each of the centrifugal flyweight members 58 has an inner surface 72 engaging the outer surface of the sleeve 28 and an outer surface 74 remote therefrom. Preferably, the inner surface 72 and the outer surface 74 are circular, cylindrically shaped, and concentric. First and second guide surfaces 76 and 78, respectively, are formed between the inner surface 72 and the outer surface 74 of each of the centrifugal flyweight members 58. The first and second guide surfaces 76 and 78 are flat and parallel to each other and to the radial plane 80 through the center of gravity of the centrifugal flyweight members. The first and second guide surfaces 76 and 78 cooperate with parallel surfaces 82 and 84 of the partial circular recesses 64 to guide the reciprocal motion of the centrifugal flyweight members 58 without permitting substantial motion in the circumferential direction.

Each of the centrifugal flyweight members 58 is also provided with an inclined surface 86 extending inwardly and angularly away from the outer surface 74 towards the inner surface 72 thereof and generally parallel to the conical inner surface 56 of the driven clutch member 30. The inclined surface 86 cooperates with the conical inner surface 56 of the driven clutch member 30 to separate the dentil teeth 34 and 36, respectively, of the driving clutch member 20 and the driven clutch member 30 during an overrunning condition. The centrifugal flyweight members 58 are also provided with a third guide surface 88 disposed remote from the inclined surface 86 and extending perpendicular to each of the first and second guide surfaces 76 and 78 between the inner surface 72 and the outer surface 74. The third guide surface 88 cooperates with the surface of a thrust washer 90 in the circular recess 32 and the thrust washer 90, in turn, engages the radially extending shoulder 24 of the driving clutch member 20. The thrust washer 90, therefore, acts as an abutment during the radial outward motion of the centrifugal flyweight member 58 which results from the rotation of the driven clutch member 30.

In operation, when it is desired to crank the engine, the starter drive 10 is shifted to the right via the shifting mechanism, not illustrated, so that the pinion gear 26 engages the starting gear 22. The power shaft 12 is rotated by a starting motor, not illustrated, and transmits torque through the straight splines 16 to the axially extending sleeve 14, and from the helical splines 18 to the driving clutch member 20. The driving clutch member 20 drives the driven clutch member 30 through the dentil teeth 34 and 36. The driven clutch member 30 thereby rotates the pinion gear 26 and the starting gear 22 of the engine.

As the engine fires and becomes self-operating, the starting gear 22 will drive the pinion gear 26 at a speed greater than that of the power shaft 12. The dentil teeth 34 and 36 will slip so that the starting motor is not driven at a high engine speed. In order to protect the dentil teeth 34 and 36 from severe wear due to the rubbing and clashing which would otherwise occur, and further to avoid unnecessary noise, the rapid rotation of the driven clutch member 30 drives the centrifugal flyweight members 58 radially outwardly. The movement of each centrifugal flyweight member 58 is guided by the partial circular recess 64 so as to prevent any motion of the centrifugal flyweight members 58 relative to the driven clutch member 30 other than the desired radial motion.

The outward motion of the centrifugal flyweight members 58 will bring the inclined surface 86 of the centrifugal flyweight members 58 into engagement with the conical inner surface 56 of the driven clutch member 30, urging the centrifugal flyweight members 58 and the thrust washer 90 to the left against the biasing force of the resilient spring member 50, as illustrated in FIGS. 1 and 2. This motion of the centrifugal flyweight members 58 is transferred through the thrust washer 90 and the radially inwardly extending shoulder 24 of the axially extending sleeve 14 to the driving clutch member 20, causing a separation of the driving clutch member 20 and the driven clutch member 30.

It will be appreciated by those skilled in the art that the starter drive 10 described above will be easier to assemble than prior art starter drive gearing since it incorporates fewer individual components and since fewer individual components must be maintained in a fixed relationship, relative to the driven clutch member 30 during an assembly operation. Furthermore, the members which must be maintained in position are larger and, therefore, generally easier to handle. Additionally, the centrifugal flyweight members 58 described above are unitary and have no passageways or bores formed therein which might tend to weaken the member or render its manufacture more difficult. Thus, a wide array of possible available materials may be used for constructing the centrifugal flyweight member 58. In particular, the centrifugal flyweight members 58 may be formed from a thermosetting plastic.

Still other advantages of the starter drive 10 of the present invention will be apparent to those skilled in the art.

The above constitutes a detailed description of the best mode contemplated at the time of filing for carrying out the present invention. It will be apparent to those skilled in the art that many variations and modifications may be made from the above described examples without departing from the spirit of the present invention. Such variations and modifications are included within the intended scope of the claims appended hereto.

What is claimed is:

1. An engine starter gearing for selectively starting an engine having a starting gear, said engine starter gearing comprising:

a power shaft;

a sleeve slidably, but non-rotatably, secured to said power shaft, said sleeve having external helical splines formed on one extremity thereof;

a pinion gear slidably journalled to said power shaft for axial movement relative thereto, said pinion gear being adapted for movement into and out of engagement with said starting gear of said engine to be started;

a driven clutch member secured to said pinion gear for movement therewith, said driven clutch member having a conical surface and a circular recess formed radially outwardly of said surface;

a driving clutch member slidably mounted on said helical splines of said sleeve, said driving and driven clutch members having complementary mutually engageable inclined teeth for transmitting torque therebetween in one direction of relative rotation;

a barrel housing having an open end, said barrel housing being slidably supported on said sleeve and at least partially spatially encompassing said driving and driven clutch members;

abutment means disposed within said barrel housing adjacent said open end thereof, said abutment means being adapted for engagement with said driven clutch member for confining said driving and driven clutch members within said housing;

resilient means disposed within said barrel housing, said resilient means abutting said driving clutch member, said resilient means further biasing said driving and driven clutch members into mutual engagement;

a radially inwardly extending shoulder formed on said driving clutch member adjacent said circular recess of said driven clutch member;

a plurality of centrifugal flyweight members annularly arranged within said circular recess, said plurality of centrifugal flyweight members each having an inclined surface abutting said conical surface of said driven clutch member, said plurality of centrifugal flyweight members being operative to displace said driving clutch member in said first axial direction in response to centrifugal force; and a plurality of cavities formed in said driven clutch member, said plurality of cavities each extending from said circular recess, each of said cavities of said plurality of cavities slidably receiving at least a portion of an associated centrifugal flyweight member of said plurality of centrifugal flyweight members to prevent circumferential movement of said plurality of centrifugal flyweight members while permitting radial movement thereof.

2. The engine starter gearing of claim 1 wherein said at least a portion of said associated centrifugal flyweight member disposed in each of said plurality of cavities is approximately axially aligned with the center of gravity of said associated centrifugal flyweight member.

3. The engine starter gearing of claim 1 wherein said resilient means and said plurality of centrifugal flyweight members apply opposed forces to said driving clutch member.

4. The engine starter gearing of claim 1 further comprising stop means movable with said pinion gear and said driven clutch member to provide a radially inward abutment stop for said plurality of centrifugal flyweight members.

5. The engine starter gearing of claim 1 wherein said plurality of centrifugal flyweight members comprises exactly three centrifugal flyweight members and said plurality of partial circular recesses comprises exactly three cavities.

6. The engine starter gearing of claim 1 wherein each of said plurality of centrifugal flyweight members comprises a unitary member comprising:

an inner surface disposed adjacent said sleeve, said inner surface having a partial circular cylindrical shape;

an outer surface disposed remote from said inner surface;

a first guiding surface extending between said inner surface and said outer surface, said first guiding surface being flat; and a second guiding surface extending between said inner surface and said outer surface, said second guiding surface being flat and parallel to said first guiding surface; said inclined surface being formed between said outer surface and said inner surface and between said first and second guiding surfaces.

7. The engine starter gearing of claim 6 further comprising:

a third guiding surface extending between said inner surface and said outer surface remote from said inclined surface, said third guiding surface being perpendicular to each of said first and second guiding surfaces and extending therebetween.

8. The engine starter gearing of claim 6 wherein said first and second guiding surfaces are parallel to the radial plane through the center of gravity of said centrifugal flyweight member.

9. The engine starter gearing of claim 6 wherein said outer surface has a partial circular cylindrical shape and is concentric with said inner surface.

* * * * *

UNITED STATES PATENT AND TRADEMARK OFFICE

CERTIFICATE OF CORRECTION

PATENT NO. : 4,715,239

DATED : September 15, 1986

INVENTOR(S) : Paul F. Giometti

It is certified that error appears in the above-identified patent and that said Letters Patent is hereby corrected as shown below:

Column 5, line 52, delete "and" and insert ---- to ----.

Column 5, line 53, delete "the axi-".

Column 5, line 54, delete "ally extending sleeve 14 to".

Signed and Sealed this

Nineteenth Day of July, 1988

*Attest:*

DONALD J. QUIGG

*Attesting Officer*

*Commissioner of Patents and Trademarks*